US005078670A

United States Patent [19]

Volkert

[11] Patent Number: 5,078,670

[45] Date of Patent: Jan. 7, 1992

[54] POP-UP PROMOTIONAL ITEMS AND METHODS OF MAKING

[75] Inventor: John K. Volkert, Northfield, Ill.

[73] Assignee: One Up, Inc., Northfield, Ill.

[21] Appl. No.: 463,118

[22] Filed: Jan. 10, 1990

Related U.S. Application Data

[63] Continuation-in-part of Ser. No. 381,047, Jul. 17, 1989.

[51] Int. Cl.[5] ..... B65H 37/04

[52] U.S. Cl. ..... 493/346; 493/381; 156/248

[58] Field of Search ..... 493/342, 346, 347, 378, 493/381, 382; 40/124.1, 530, 533; 446/148; 156/248, 249

[56] References Cited

U.S. PATENT DOCUMENTS

| | | | |
|---|---|---|---|
| 2,360,973 | 10/1944 | Pedersen | 493/346 |
| 4,657,612 | 4/1987 | Schoenleber | 446/148 |
| 4,661,189 | 4/1987 | Voy et al. | 156/248 |
| 4,662,971 | 5/1987 | Adams | 156/248 |
| 4,699,679 | 10/1987 | Cartmell | 156/248 |

FOREIGN PATENT DOCUMENTS 2166109 4/1986 United Kingdom .

*Primary Examiner*—James G. Smith
*Assistant Examiner*—Jack Lavinder
*Attorney, Agent, or Firm*—Fitch, Even, Tabin & Flannery

[57] ABSTRACT

Pop-up items are provided which can either be mounted in three-dimensional form on a suitable supporting surface by means of pressure-sensitive adhesive carried by the item or can be affixed to facing panels of a letter or pages of a book. The item may include one or more basepieces plus a pop-up element or a pop-up element alone in the form of one or two panels. When one basepiece is attached, or when mounted between facing panels, upon opening, the pop-up element assumes a three-dimensional configuration as a result of pressure-sensitive adhesive bonding to the surface of a facing panel or page. A variety of methods for the mass production of such pop-up items from a continuous web, e.g., the printed and die-cut web from a web press, facilitate their inexpensive fabrication. These items are preferably marketed or distributed in groups, e.g. attached to a continuous strip of sheet material that might be rolled or fan-folded, or in the form of stacks or pads from which a single item can be peeled off and affixed.

5 Claims, 6 Drawing Sheets

41"
25
49

41"
49
25
23

25
25
25
41'
25
25
51
41'
53
25
57
41'
25
25
55
53

65
63
61

67
62b
62a
FOLD
61
63
65

69
65
71
65
61
61
63
67

75
71

71
62b
63
65
67
62a 67
62b
62a
63
81

85
63
62b 89
62a
63
87
85
62b
89
63
87
62a

NOTICE

POP-UP PROMOTIONAL ITEMS AND METHODS OF MAKING

This application is a continuation-in-part of my copending application Ser. No. 381,047, filed July 17, 1989.

This invention relates to printed novelty items made of paper or other sheet material and more particularly relates to promotional pop-ups multiple copies of which can be fabricated from separate sheets or from a continuous web and mass production methods of making such items from a continuous web, as on a web-press or the like, which items assume three-dimensional configuration and are designed to permit mounting in such orientation.

BACKGROUND OF THE INVENTION

Pop-ups have fairly recently become frequently used in advertising and in other promotional endeavors, whereas they had been used in the greeting card field and in children's books for a number of years. Such pop-up pieces have become generally available to the advertising field as a result of the developments shown in several earlier patents, particularly U.S. Pat. No. 3,995,388, issued Dec. 7, 1976, which discloses methods for making pop-up paper products having significant advantages over hand-assembly methods that had been generally theretofore employed. U.S. Pat. No. 4,146,983, issued Apr. 3, 1979, discloses other methods for making novel promotional items, particularly those which are designed to present a plurality of coupons or the like to a recipient upon the opening of a folder. U.S. Pat. No. 4,337,589 discloses manufacturing techniques, specifically suited for mass production on a web-press or the like, for making pop-up advertising pieces and the like, the details of the disclosure of which are incorporated herein by reference.

The foregoing patents describe different manufacturing techniques useful for making advertising and promotional pop-ups as a part of a continuous web arrangement, and pop-ups such as these have been frequently used to create impact and enjoyment in books, in greeting cards and in advertising inserts. The foregoing advances in designs and in manufacturing methods have enabled volume production of such products at significant cost savings and thus have increased their use.

A general characteristic of such pop-ups is the movement of the pop-up element from a flat, substantially single plane into a three-dimensional orientation upon the opening of a pair of cover pieces or basepieces, generally in the form of a folder inside which the pop-up is located. By attaching the pop-up elements to opposite panels of the basepieces, for example, along angles created by lines of weakness, such as score lines and/or perforations, in combination with adhesive bonds, pressure or stress points are created which, upon opening of one cover, cause the pop-up to be erected. However, the pressure or stress which is created upon opening is sufficient so that, when the cover is manually released, it will draw the cover either partially or entirely closed.

Although a pair of basepieces have heretofore been utilized in such pop-up units, it has now been found that improved pop-up designs are feasible that eliminate one or more of the basepieces, as are methods for mass production of such improved designs.

SUMMARY OF THE INVENTION

Improved pop-up items and methods for making such items are provided in the form of either a basepiece that is pivotally interconnected to a pop-up element or individual pop-up elements. The exterior surfaces of such basepieces and pop-up elements carry pressure-sensitive adhesive, and the adhesive-carrying surfaces may optionally be covered by release liners. Once such optional release liners are removed from exterior surfaces, the pop-up item can be affixed to a supporting surface in attention-attracting three-dimensional orientation, or between facing panels or pages where it will assume such orientation upon opening.

Such pop-up items can be adhesively attached to a carrier strip or web for distribution as a part of an arrangement which facilitates handling, storage and distribution of the pop-up items. These pop-up items are susceptible to distribution in the form of a stack or pad from which the recipients can one-by-one remove and utilize individual items. Mass production methods of manufacturing such pop-up items are likewise provided in order to facilitate volume production at affordable cost.

DETAILED DESCRIPTION OF THE PREFERRED EMBODIMENTS

Figure 1:
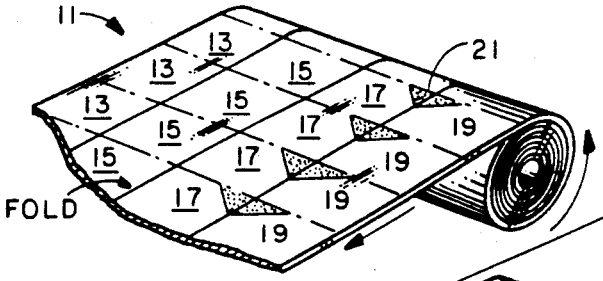
FIG. 1 is a perspective view of a continuous web which has been printed so as to define a series of blanks each containing a pair of basepieces and a pair of pop-up panels, illustrating the web after a glue pattern has been applied thereto.
Figure 5:
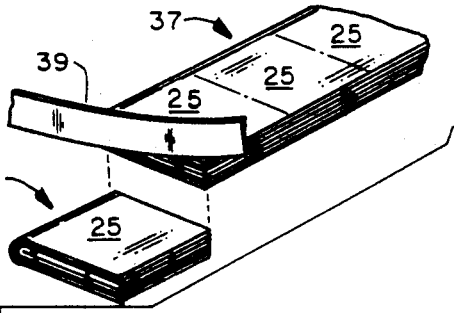
FIG. 5 shows the folded web of FIG. 4 as it might be thereafter handled so as to produce individual pop-up carrying pieces.
Figure 8:
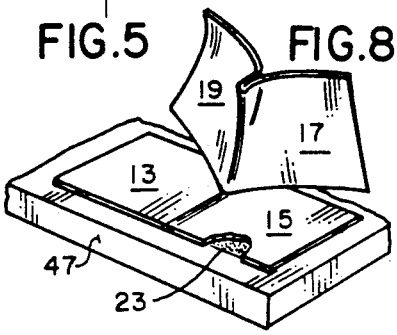
FIG. 8 is a perspective view showing one of the pop-up items illustrated in FIG. 5 mounted on a horizontal surface, such as a shelf, in its open or display position.

FIG. 1 shows a continuous web 11 as it may be running on a web-printing press or being unrolled from a preprinted roll, depicting a series of structurally identical printed blanks which could, if desired, be appropriately preliminarily die-cut; the blanks are designed to, following fabrication, form a series of promotional pieces such as that illustrated in FIGS. 5 and 8. Each blank is aligned laterally across the continuous web 11, the direction of movement of the web being shown by the arrows in the Figure. The dot-dash lines illustrate the transverse lines along which each blank, following folding, will be severed from the next adjacent blank to complete fabrication of an individual piece.

In the blanks illustrated in FIG. 1, a pair of basepieces 13 and 15 are arranged next to one another with a pair of pop-up panels 17, 19 located laterally next to the edge of the basepiece 15. Also shown in FIG. 1 are printed, longitudinally extending, parallel lines that divide each blank into four panels. Some or all of these lines could actually be formed as lines of weakness in the web, as for example, by pressing, scoring or slightly perforating; alternatively, they may be omitted and simply left to be formed as a result of the subsequent folding operations performed on the web. It is generally satisfactory to simply rely upon the natural resiliency of the paper web to effect appropriate bending of the pop-up elements as a result of the particular placement of an adjacent line of adhesive without actually providing a line of weakness; however, lines of weakness within the regions of the pop-up panels can be employed to create a neater appearance in the final product. As a part of the manufacturing operation, the same die-cutting, adhesive-applying and folding steps are effected with respect to each of these successive blanks of the continuous, sheet material web, which is preferably made of a suitable paper or paperboard material, glossy or matte finish as desired, but which might possibly be an appropriate plastic sheet material.

As a part of an adhesive application step, a glue pattern 21 of generally triangular form is applied so that it covers portions of both pop-up panels 17 and 19, which pattern is eventually used to join the pop-up panels to the interior surfaces of the basepieces 13, 15. If desired, such a glue pattern could instead be applied to the appropriate locations on the basepieces 13, 15. Although these are commonly referred to in the trade as glue patterns, any suitable adhesive, e.g., hot-melt or solvent-based, can be used in such a fabrication process. Other such adhesive arrangements, such as detailed in the aforementioned patents, including heat, ultrasonic or RF-activated or micro-encapsulated adhesives, can alternatively be used. If desired, co-adhesive patterns of a material that will only adhere to itself can be applied to the appropriate locations of both surfaces, as is known in this art.

Figure 2:
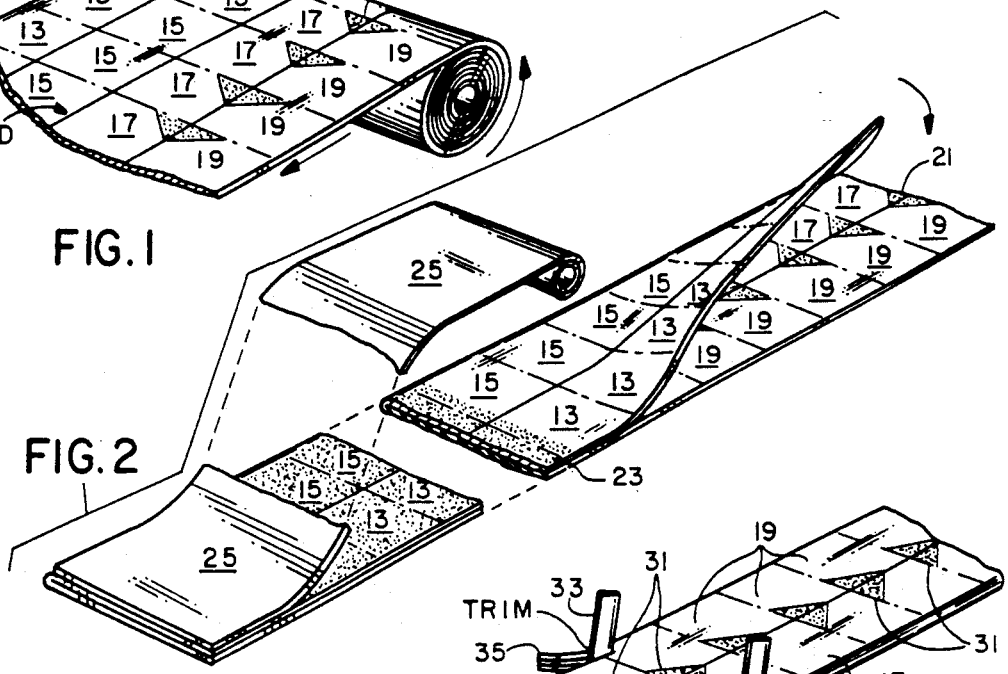
FIG. 2 is a similar perspective view showing the web of FIG. 1 after it has been folded onto itself, illustrating the application of pressure-sensitive adhesive to the upper surface of the folded web followed by the association of a continuous sheet of liner material thereupon.

Following the application of the glue pattern 21, the web is folded upon itself along the longitudinal line between the panels 15 and 17, as depicted in FIG. 2, thereby joining together triangular portions of the panels 13 and 19 and of the panels 15 and 17, respectively, in the region of the glue pattern 21. Following the folding operation, the upper surface of the folded web constituting the basepiece panels 13 and 15 is substantially completely coated with pressure-sensitive adhesive 23. Next, a web 25 of liner material of appropriate width is brought into association with the upper surface of the folded web so as to completely cover the pressure-sensitive adhesive surface. The undersurface of the liner material web 25 depicted in FIG. 2 is appropriately precoated with a silicone or some other suitable release agent so as to allow it to be stripped cleanly from the basepieces exposing the pressure-sensitive adhesive, as is well known in the art. As an alternative to first creating the folded web of superimposed pairs of basepiece panels and pop-up panels and then applying pressure-sensitive adhesive and a liner sheet, it would be acceptable to purchase sheet material in roll form in the form of a ply of blank paper joined by pressure-sensitive adhesive to a release liner and thereafter print the interior surfaces of the basepiece panels 13 and 15 onto the blank paper ply. Thereafter, through the appropriate application of the glue patterns 21, this two-ply web could be associated with a continuous printed web of suitable width to constitute the pop-up panels 17, 19.

As a further alternative, if desired, instead of folding the web onto itself as illustrated in FIG. 2, the web could be longitudinally severed along the line between panels 15 and 17 and the left-hand portion of the web moved into superimposed position atop the right-hand portion. Similarly, two different webs, which could be of similar widths or slightly different widths, could be used to produce the basepiece panels and the pop-up panels, respectively, and such an arrangement would likely be employed should it be desired to form the basepiece panels, for example, of heavier stock material or of a material having different surface characteristics from that of the pop-up panels. In all of these embodiments, the basepieces 13, 15 are preferable fabricated from a single sheet so as to be integral with each other, being connected along a common foldline.

As a still further alternative, it would be possible to first coat one surface of the left-hand portion of the web 11 of FIG. 1 with pressure-sensitive adhesive and then apply the continuous web of liner material 25 in association therewith to cover the adhesive before the web is either folded onto itself or severed and laterally displaced so as to associate the other surface of the left-hand half of the web with the right-hand half which constitutes the pop-up panels.

Figure 3:
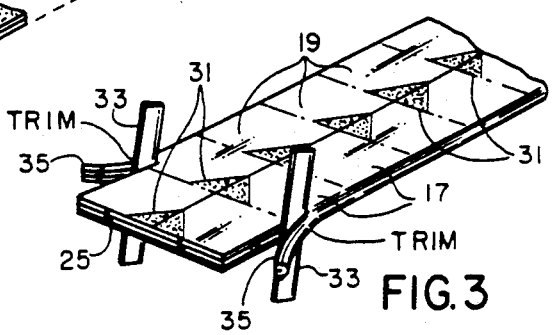
FIG. 3 shows the composite web of FIG. 2 after it has been rotated 180 to facilitate the application of a further adhesive pattern in the region of the pop-up panels followed by the trimming of both lateral edges of the composite web.

As depicted in FIG. 3, the composite web consisting of the folded over web 11 and the liner material 25 is preferably rotated 180 to facilitate the application of adhesive patterns 31 to the regions of the pop-up panels 17, 19, which would then be located at the upper surface of the composite continuous web. Although such rotation is preferable, it is not necessary, and the glue patterns could be applied to the undersurface of the web without such 180 rotation. Next, as depicted in FIG. 3, both lateral edges of the composite web are trimmed by the use of suitable knife blades 33 or the like, and the trim material 35 is discarded. Alternatively, the trimming of the lateral edges could take place prior to the application of the glue patterns 31. Moreover, instead of applying glue patterns 31 to both of the pop-up panels 17, 19, a single glue pattern could be applied to just one of the panels.

Figure 4:
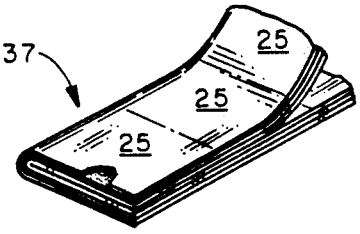
FIG. 4 shows the web of FIG. 3 after it has been again folded upon itself.

Following the trimming operation, the web is again folded upon itself along the longitudinal line between the panels 17 and 19 to the orientation 37, depicted in FIG. 4, so that the glue patterns 31 interconnect the pop-up panels to each other and so that the interconnected pop-up panels are sandwiched between the basepieces 13, 15 which constitute a folder, the outer surface of which is covered by the pressure-sensitive adhesive 23 and the liner material 25. Thereafter, there are alternative ways of treating the finally-folded web 37 depending upon how it is intended that the pop-up pieces are to be stored and distributed. As well known in the art, it is often preferable to run the finally-folded web 37 through a set of compression rolls so as to assure a strong adhesive bond is created at the desired points. Likewise, a further trimming operation could be carried out along the right-hand edge of FIG. 4, if desired, and only such a trimming operation might be also used instead of trimming both edges, as depicted in FIG. 3.

If the pop-up pieces are to be delivered as single individual units, a transverse severing of the web is then effected using a suitable knife blade mechanism 39 or the like, which could be part of a rotating device, to create the individual, structurally identical units 41. Should it be desired to maintain the pop-ups in strip form, instead of using a knife 39 to completely sever adjacent units, an appropriate line of perforations could be imposed at this point; thereafter, the continuous web could be wound in roll form or could be fan-folded at each of the lines of perforation to create a strip of interconnected pop-up pieces.

Figure 6:
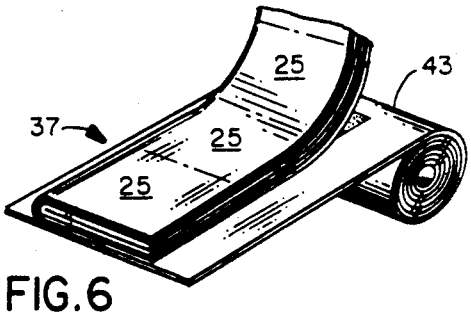
FIG. 6 illustrates an alternative to FIG. 5 wherein the folded web of FIG. 4 is associated with a continuous carrier sheet.
Figure 7:
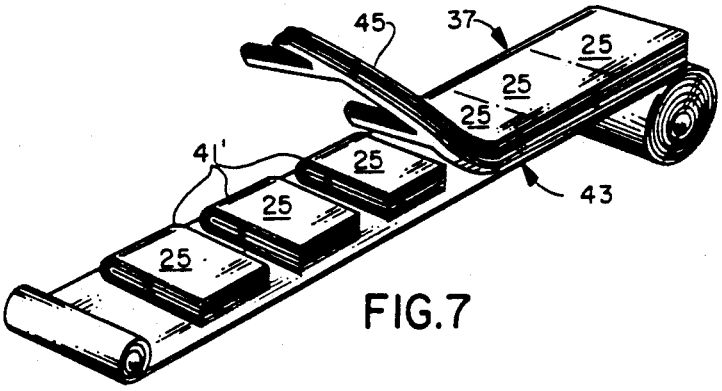
FIG. 7 shows treating the associated web arrangement of FIG. 6 to create a plurality of structurally identical, spaced apart, individual pop-up-carrying pieces on the continuous carrier sheet.

A further alternative is shown in FIG. 6 wherein the finally-folded, continuous web 37 is associated with a web of carrier material 43, the upper surface of which is either precoated or coated at that time with a weak-bond, pressure-sensitive adhesive; the carrier web 43 may be slightly wider than the finally-folded composite web 37. Thereafter, as depicted in FIG. 7, a "kiss-cut" die-cutting operation is effected to cut through all of the thicknesses of the composite web 37 but not to cut into the continuous carrier web 43. The result of such die-cutting is to create a plurality of individual pop-up containing units 41' at uniformly spaced locations along the carrier web 43, and the die-cut scrap material formed as a part of the kiss-cut operation, as indicated by the reference numeral 45, is stripped from the web using state of the art techniques. Thereafter, as depicted in FIG. 7, the carrier web and its series of structurally identical pop-up carrying pieces 41' can be conveniently wound into a roll form for storage and/or shipping, either by rolling the web in the direction shown or in the opposite direction. When it is desired to distribute the items, because of the relatively weaker bond between the carrier 43 and the liner 25, the individual units 41' can be removed therefrom without detaching the liner material 25 from the basepieces.

By reference to FIG. 8, it can be seen that opening the folder, by pivoting the basepieces 13 and 15 along their straight foldline of interconnection, causes the pair of pop-up panels which constitute the central pop-up element to be stressed (as a result of their interconnections to the basepieces in the triangular regions provided by the glue pattern 21) and causes them to rise up out of the planes of the basepieces and assume a three-dimensional, attention-attracting configuration guided also by the interconnection at the glue pattern 31. By stripping all or a part of the liner material 25 from the exterior surfaces of the basepieces 13 and 15, the pressure-sensitive adhesive 23 becomes exposed and allows the open piece to be easily and quickly affixed to an appropriate supporting surface, such as the upper surface of a horizontal shelf 47 or the like. This attachment to the shelf surface resulting from the pressure-sensitive adhesive bond assures that the piece 41 remains affixed in the open position with the pop-up element prominently displayed in its three-dimensional configuration.

Figures 9, 10, 11, 12, 13, 14, 15, 16, 17, 18, 19:
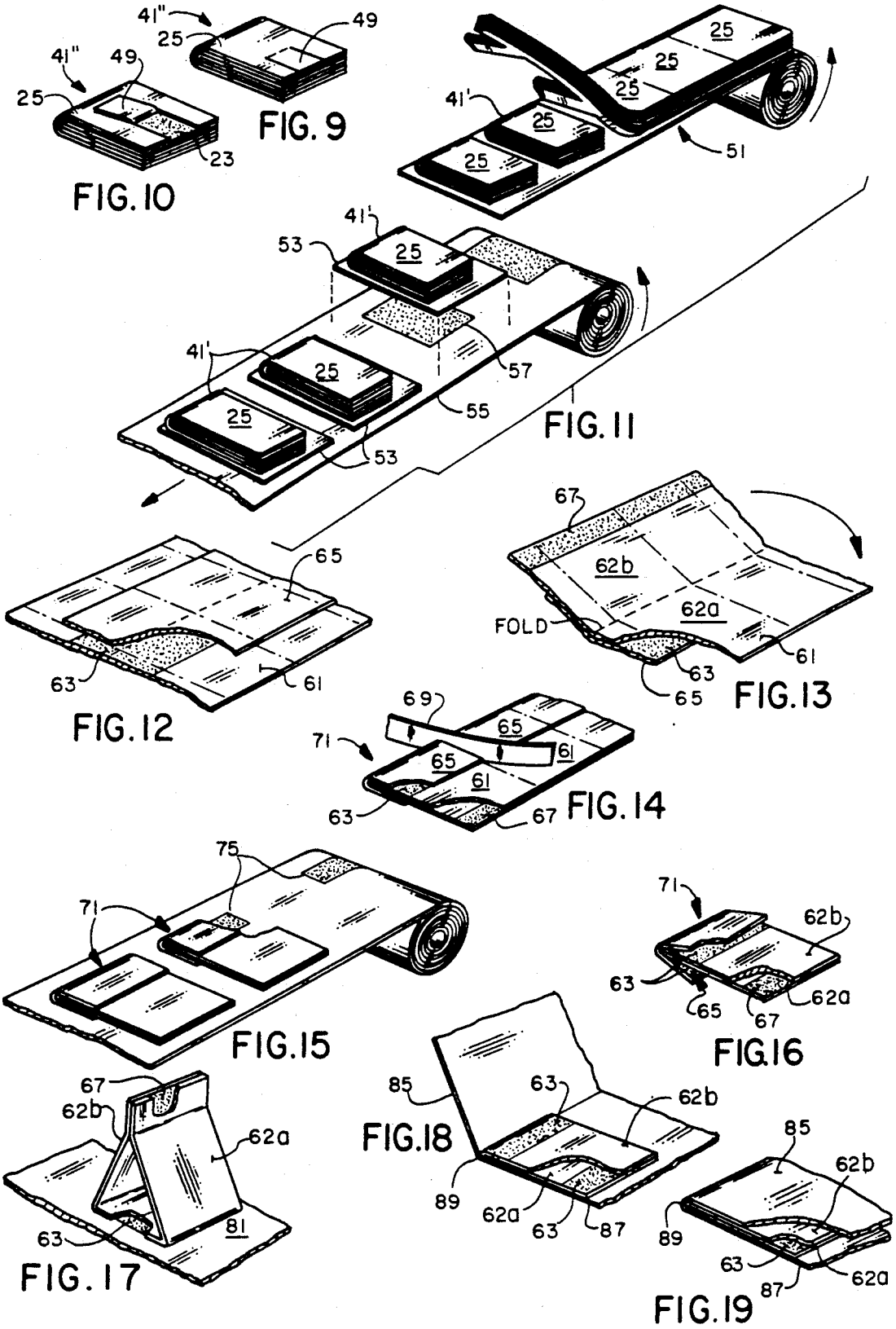
FIGS. 9 and 10 show alternative versions of the pop-up piece illustrated in FIG. 5.
FIG. 11 illustrates an alternative method for making pop-up pieces attached in piggyback form to an intermediate substrate which is in turn cut into discrete units that are attached for handling and storage purposes to a continuous web.
FIG. 12 is a schematic perspective view showing the initial steps of manufacture of a pop-up element of an alternative design.
FIG. 13 shows the composite web of FIG. 12 rotated 180 with an adhesive pattern being applied.
FIG. 14 shows the web of FIG. 13 after it has been folded onto itself and as the severing into individual units is being carried out.
FIG. 15 illustrates how the individual units might be placed onto a carrier web for handling storage and/or distribution purposes.
FIG. 16 is a schematic view showing the manipulation of the pop-up element produced in FIG. 15.
FIG. 17 is a perspective showing how the pop-up of FIG. 16 might be mounted directly upon a surface in three-dimensional form.
FIGS. 18 and 19 are schematic views showing an alternative way in which the pop-up elements of FIG. 16 can be attached to supporting surfaces.

Should it be desirable to provide a piece that can be temporarily fixed in one location and then removed and later affixed in a different location, it might be preferable to die-cut the liner sheet 25 so as to facilitate only partially exposing the pressure-sensitive adhesive surface, as shown for example in FIGS. 9 and 10. Depicted is a modified piece 41'' in which the liner material has been kiss-cut or otherwise suitably die-cut to leave short links that easily rupture so as to create a hinged panel 49 at an appropriate, e.g., a central, location in the liner sheet portion covering the exterior surface of each of the basepieces 13, 15. By stripping the hinged panel 49 from the adhesive surface and folding it rearward onto the remainder of the liner 25, as depicted in FIG. 10, less than 20% of the pressure-sensitive adhesive surface area is exposed. The central location arrangement assures that the pop-up can still be securely mounted; yet as a result, the piece might be removed from one surface and firmly re-affixed to a second suitable supporting surface after removing the entire liner sheet 25. Instead of hinging the panel 49 to the remainder of the liner panel 25, it can be left connected along a line of perforations or completely severed therefrom to facilitate its complete removal.

Should it be desired to distribute the pop-up pieces in piggyback form in combination with an intermediate substrate, a process generally as depicted in FIG. 7 could be employed so as to create a series of structurally identical pop-up pieces 41' located in spaced arrangement along a continuous web 51, as depicted in FIG. 11, using a web 51 of a suitable material to serve as a piggyback substrate. Thereafter, the web 51 is transversely severed into a series of individual units each of which constitutes a pop-up piece 41' attached to an intermediate substrate 53 in piggyback fashion. These units are then applied to a carrier web 55 upon which has been applied a suitable, releasable, adhesive pattern 57, or the undersurface of the web 51 could have a suitable adhesive applied to it, preferably prior to its being severed. Alternatively, the folded web 37 as carried by the substrate web 43, as shown in FIG. 6, might also be affixed directly to an adhesive-bearing web 55 or to a plain web after having an adhesive pattern applied to the undersurface of the web 43; thereafter, kiss-cutting is performed to fashion the individual piggyback units. As another alternative, a composite web having a layer of adhesive sandwiched between two continuous webs could be used instead of the webs 51 and 55, and a first kiss-cutting step would be used to create the individual pieces 41 followed by a second kiss-butting step to create the substrates 53. As a further alternative, the individual pieces 41 could be produced as depicted in FIG. 5 and then placed individually onto the web 51 in alignment with adhesive patterns applied thereto using commercially available state-of-the-art equipment. The characteristics of the various adhesives used can be such as taught in U.S. Pat. No. 4,479,838, the disclosure of which is incorporated herein by reference. More particularly, the adhesive pattern 57 should be the weakest so that when the piggyback unit is ready for removal from its "storage" location on the carrier web 55, it can be easily peeled from the carrier 55, using automated equipment if desired, and placed in its distribution location. For example, it may be desired to distribute the piggyback items on the exterior surface of a package, attached to a stand-alone promotional folder or by insertion into a magazine or a book.

In such an instance, it might be desirable to use a thin transparent material, e.g., thin thermoplastic material, for the web 51 from which the intermediate substrates 53 would be cut. In this manner, the transparent substrate 53 can be allowed to ultimately remain in place where it is located following removal of the pop-up piece 41' because it will not obscure any underlying printing. Furthermore, in order to facilitate its ultimately remaining in place, the adhesive which is used to attach the piece 41' to the web 51 should preferably be a "dry residue" adhesive that is also transparent, as is known in the art. This dry residue adhesive should have a greater adherence strength than the adhesive pattern 57, but it should have a lower adhesive strength than the pressure-sensitive adhesive with which the basepieces are bonded to the liner material 25 so that the piece 41' can be stripped from the intermediate substrate 53 by the ultimate recipient, leaving only the transparent substrate which would likely be bonded by a substantially permanent, transparent adhesive in the location on a package or folder or the like where distribution occurs. It is contemplated that the webs 55 of carrier material with the attached piggyback arrangements would then be rolled for storage and shipping purposes, as described hereinbefore.

Disclosed in FIGS. 12–14 is a method for making pop-up elements 71 without the attached basepieces in flat-folded condition, which pop-up elements can be distributed as novelty items or the like. More particularly, a continuous web 61, which is preferably printed in the form of a series of pop-up elements each including two pop-up panels **62*a* and 62*b*, is coated with a central strip 63 of pressure-sensitive adhesive, as shown in FIG. 12. A continuous liner 65 is then brought into superimposed relationship atop the pressure-sensitive adhesive strip to completely cover it, and the composite strip is preferably rotated 180 in order to reach the orientation shown in FIG. 13 where the liner web 65 is lowermost. A continuous adhesive pattern 67 is then applied along one edge (or both edges, if desired) of the web 61, and the composite web is then folded in half onto itself along its longitudinal centerline so that the adhesive pattern 67 interconnects the two lateral edges of the original web 61 that will constitute the pop-up panels, as depicted in FIG. 14. The folded web is then severed by a knife blade 69 or the like, a plurality of structurally identical pop-up elements 71**.

If desired for distribution, these units 71 can be mated to a continuous carrier web 73, as depicted in FIG. 15, to which a suitable adhesive pattern 75 is applied using an adhesive that will have a lower bond strength than the adhesive 63 so that the pop-up elements 71 can be readily removed from the web by the recipient when ready for use without peeling the liner 65 from the pop-up panels 62 Thereafter, as shown in FIG. 16, the liner 65 is stripped from the outer surface of the pop-up panels **62*a* and 62*b*, exposing the pressure-sensitive adhesive pattern 63. By handling the pop-up element 71 near its upper edge where the pop-up panels 62*a* and 62*b* are interconnected by the adhesive pattern 67, the recipient can mount the pop-up element directly onto a flat, supporting surface 81, as depicted in FIG. 17, by moving the element 71 perpendicular to the surface so that it opens after the foldline between the panels 62*a*, 62*b* engages the surface and the pressure-sensitive adhesive-carrying portions of the panels become affixed to the surface 81**.

Alternatively, as depicted in FIGS. 18 and 19, following removal of the liner 65, the pop-up element can be inserted between a pair of facing sheets or panels 85, 87 that are associated with each other in generally hinged relationship thereto along a straight hinge line 89. They may, for example, be sections of the same page of a letter folded along a crease line 89. They could be facing pages of a larger paperboard folder or menu, or they could be adjacent pages of a magazine or book having a common backbone. As illustrated in FIG. 18, the pop-up element 71 is located so that the panel **62*a* becomes attached to the surface of the panel 87, and when the panel 85 is folded into superimposed relationship along the hinge line 89, it becomes attached to the other pop-up panel 62*b* by the exposed pressure-sensitive adhesive which it carries. Thereafter, when the panels 85 and 87 are opened, pivoting along the hinge line 89, the pop-up 71 automatically opens and assumes a three-dimensional configuration similar to that depicted in FIG. 17**.

Figures 20, 21, 22, 23, 24, 25, 26, 27, 28, 29, 30, 31, 32, 33, 34:
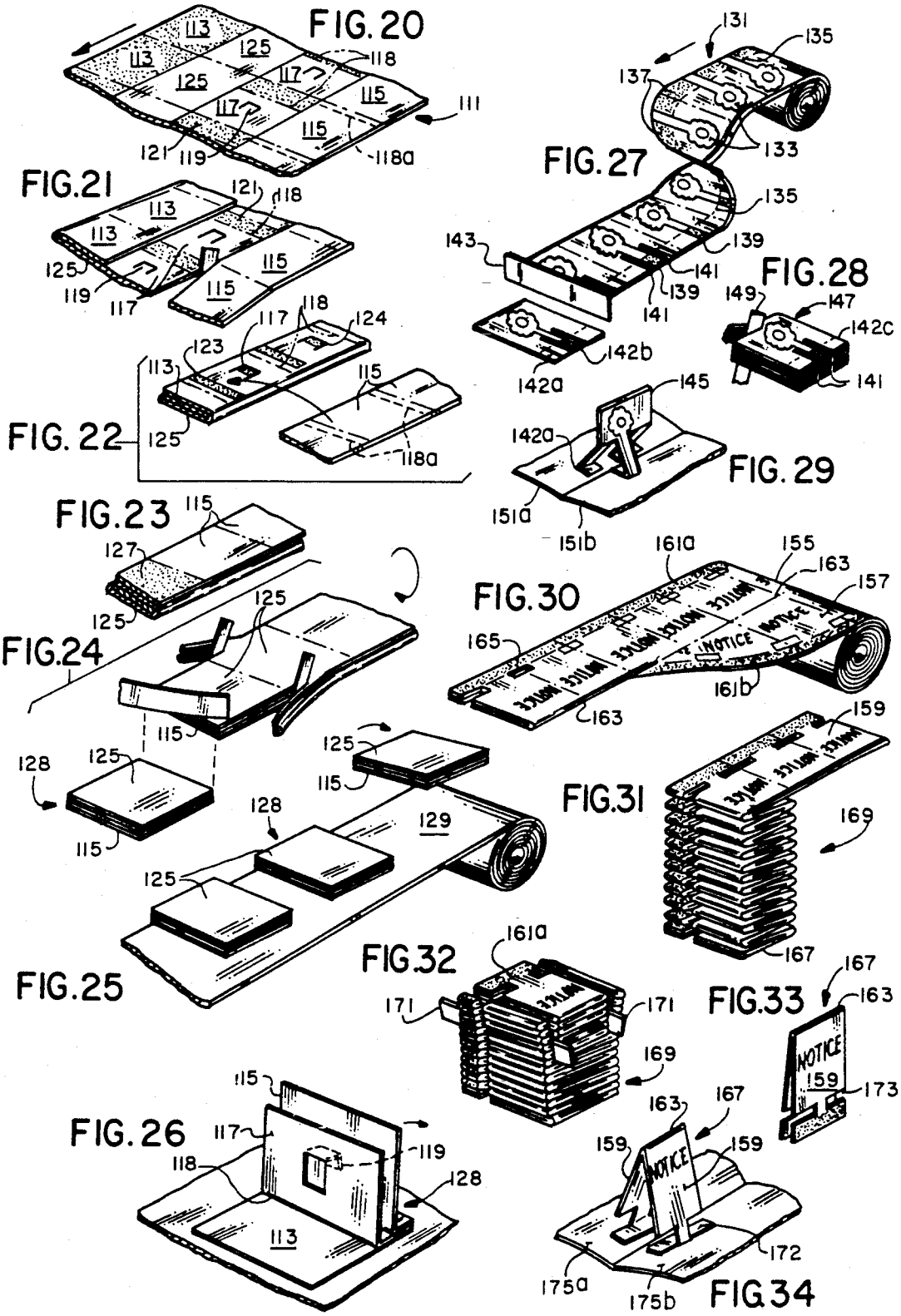
FIG. 20 is a perspective view of a continuous web which has been printed so as to define a series of blanks containing a pair of basepieces, a single pop-up panel and one liner panel illustrating the web following die-cutting and the application of adhesive, which web is useful in the creation of individual pop-up carrying pieces of a further alternative embodiment to those formed from the continuous web shown in FIG. 1.
FIG. 21 is a similar perspective view showing the web of FIG. 20 after it has been folded onto itself and illustrating the severing of a separate ribbon from the main body of the web.
FIG. 22 shows the main web of FIG. 21 after it has been folded a second time and following the application of an adhesive pattern to the upper surface of the twice-folded web.
FIG. 23 shows the superimposition of the severed ribbon onto the upper surface of the twice-folded web.
FIG. 24 is a perspective view showing the composite web as its lateral edges are being trimmed and as a pressure-sensitive adhesive pattern is being applied to the uppersurface, followed by the severing of the web into a plurality of individual units.
FIG. 25 shows the rotation of the individual units 180 and their application to a roll of liner material.
FIG. 26 is a perspective view showing one of the pop-up pieces illustrated in FIG. 24 mounted on a horizontal surface in its open or display position.
FIG. 27 is a perspective view of a continuous web which has been printed so as to define a series of blanks each containing a single pop-up unit which web is shown as being manipulated and then severed to create such individual pop-up units.
FIG. 28 is a perspective view showing a stack of pop-up units of the type created in FIG. 27.
FIG. 29 is a perspective view showing one of the pop-up units fabricated in FIG. 27 mounted to a pair of hinged panels which are opened so the pop-up unit is in its display condition.
FIG. 30 is a perspective view of a continuous web which has been printed so as to define a series of blanks each containing a pair of panels which together form pop-up units of still another design.
FIG. 31 shows a segment of the web fabricated in FIG. 30 being fan-folded into a stack of pop-up units.
FIG. 32 shows the trimming of such a stack so as to create a plurality of individual units.
FIG. 33 is a perspective view of one such individual unit from the stack of FIG. 32.
FIG. 34 illustrates the pop-up unit of FIG. 33 attached to a pair of panels that are hinged together.

Disclosed in FIGS. 20–26 is an alternative method for making pop-up units wherein a single pop-up panel is employed and wherein one of the liner panels is fashioned from the continuous web of paper material by the application of appropriate release coating thereto. Shown in FIG. 20 is a continuous web 111, the direction of movement of which is shown by the associated arrow. The web is suitably printed to depict a series of structurally identical blanks, each of which contains four separate panels arranged side by side across the width of the web. A pair of basepiece panels 113 and 115 are located along the two lateral edges of the continuous web 111. A single pop-up panel 117 is arranged adjacent the basepiece panel 115, and a liner panel 125 is located between the basepiece panel 113 and the pop-up panel 117. The basepiece panel 113 is coated with an overall pattern of pressure-sensitive adhesive, as illustrated in FIG. 20, whereas a release coating (not shown) is preferably applied to the region of the web which constitutes the liner panels 125. The portion of the web which constitutes the pop-up panels 117 is preferably scored, perforated, or otherwise suitably treated so as **118*a* is located in each of the basepieces 115. An adhesive pattern 121 is applied to the upper surface of the panels 117 in the region between the line of weakness 118** and the adjacent edge of the blank.

As illustrated in FIG. 21, the first folding step folds the lateral edge of the web 111, which constitutes the basepieces 113, onto the release-coated liner panels 125. As also illustrated, a ribbon is severed from the main portion of the web, which ribbon is that part of the web which constitutes the basepieces 115 lying along the other lateral edge thereof.

Following severing of the ribbon, the portion of the web constituting the pop-up panels 117 is folded onto the once-folded web so that the pop-up panels are superimposed atop the basepiece panels 113, with the adhesive pattern 121 creating a joinder between the respective panels along the trailing edges thereof. Following folding, adhesive patterns are applied to the upper surface of the twice-folded web in the form of a transverse strip of adhesive 123 and a generally rectangular spot 124 of adhesive which is positioned on the die-cut tab 119. The transverse strip 123 extends across the panel in a region which corresponds to the region between the trailing edge of the blank and the transverse line of weakness 118*a* and covers a surface area equal to about half of the area of the region between the trailing edge of the pop-up blank and the line of weakness 118.

Following the application of these adhesive patterns, the severed ribbon containing the basepiece panels 115 is superimposed upon the twice-folded ribbon, as shown in FIG. 23, and if desired, suitable compression can be applied to the composite ribbon to assure good adhesive bonds are created between the pop-up panels 117 and the flanking basepieces 113 and 115 through the adhesive patterns 121, 123 and 124. Then a pressure-sensitive adhesive pattern 127 is applied to the upper surface of the basepieces 115.

Following application of the overall pressure-sensitive adhesive pattern 127, the composite web is then inverted by rotation 180 so that the basepiece panel 115 constitutes the lower surface and the liner panel 125 constitutes the upper surface. As depicted in FIG. 24, the lateral edges of the composite ribbon are trimmed to eliminate the folded interconnections in the twice-folded web, and the composite web is suitably transversely severed into structurally identical individual units or pieces 128.

As depicted in FIG. 25, the units 128 are located in spaced-apart positions along a continuous strip 129 of release-coated paper or the like. Alternatively, the blanks can be appropriately sized, and the composite strip, following trimming, can be severed into individual units 128 by kiss-cutting, as shown in FIG. 11. The strip 129 can be unwound from a roll and can be rerolled after application of the individual units 128. Alternatively, the strip 129 carrying the individual units 128 can be fan-folded if desired. It is contemplated that it may be desirable to market such pop-up pieces 128 in groups of 10 or 20 or the like, and fabrication in this fashion would facilitate distribution in this manner.

As best seen perhaps in FIG. 26, the adhesive patterns 121 and 123 create a false backbone region between the basepieces 113 and 115 and the pop-up panel 117 allowing the basepiece 115 to be pivoted relative to the basepiece 113, generally along the line of weakness 118*a*, after the completed unit has been removed from the continuous strip 129 and affixed to an appropriate supporting surface, such as upon the upper surface of a horizontal shelf or the like, where the pressure-sensitive adhesive pattern on a basepiece holds it firmly thereto. For example, after the liner panel 125 is stripped from the basepiece 113, the piece 128 can be opened to the position shown in FIG. 26 wherein the pop-up panel 117 is displayed in a three-dimensional configuration between the two basepieces, which results from its attachment via the wide, adhesive pattern 121 to the basepiece 113 and its attachment in the region of the die-cut tab 119 to the basepiece 115. The pressure-sensitive adhesive pattern on the basepiece 113 that was exposed by the stripping of the liner panel 125 and the pressure-sensitive adhesive pattern 127 allow the pop-up piece 128 to be mounted in a fully open three-dimensional configuration by completing the pivoting of the basepiece 115 as depicted by the arrow in FIG. 26. Alternatively, if the piece 128 was affixed to a wall or other vertical surface via the adhesive pattern on the basepiece 113, gravity could be relied upon to maintain it in the open position. Of course, it should be understood that the die-cut pop-up panel 117 could be die-cut to different configurations than that illustrated, which would likewise assume a three-dimensional configuration upon the pivoting of the basepieces.

Disclosed in FIGS. 27 through 29 is a method for making single sheet pop-up elements without attached basepieces which, as a result of their pressure-sensitive adhesive patterns, are adapted to be placed individually between the pages of a pamphlet or book or at the fold-line between panels of a personal letter, as generally hereinbefore illustrated with respect to the item fabricated in FIGS. 12–15, as shown in FIGS. 18 and 19. Illustrated in FIG. 27 is a continuous web 131 which is preferably printed in the form of a series of structurally identical pop-up elements 133, each having a line of weakness 135 impressed along the left hand edge to provide attachment panels in that region. Pressure-sensitive adhesive patterns 137 are first applied to the upper surface of each of the individual blanks 133 in these regions along both the leading and trailing edges of each of the individual blanks 133. Following application of the adhesive patterns 137, the continuous web 131 is rotated 180 to facilitate the application of adhesive patterns 139 to the opposite surface. However, depending upon the manufacturing equipment available, the adhesive patterns 139, which are shown as being subsequently applied to the opposite surface of each individual blank in a generally central region of the attachment panels, could instead be applied to the underside of the continuous web.

Following the application of the pressure-sensitive adhesive patterns 137, 139 to both surfaces, the web is die-cut to provide a pair of slits 141 extending inward from this lateral edge past the line of weakness 135 thereby providing, in each individual blank, three separate attachment subpanels 142*a*, b and c in the region laterally outward of the line of weakness 135. If desired, additional die-cutting could be carried out at the same time in the region of the printed pattern in the remainder of each of the blanks 133 in order to contour this edge (which becomes the upper edge of the pop-up) to render it more attractive. The continuous web 131 is then severed by a reciprocating or rotary knife blade 143 or the like, as are well known in this art, into a plurality of structurally identical individual pop-ups 145 which are collated into stacks of a desired number, as represented by the reference numeral 147 in FIG. 28. One or more of the edges of the stack 147 can then be trimmed, as by a knife 149 as depicted in FIG. 28, so as to present a stack with a neat edge appearance. Moreover, instead of die-cutting the continuous web, as depicted in FIG. 27, it is also possible to die-cut the completed stack 147 to produce the pair of parallel slits 141 in each individual pop-up element 145.

Adjacent pop-up elements 145 in the stack are held in face-to-face contact with one another by the adhesive patterns 137 and 139 on the opposite surfaces of each individual element. However, if desired, the stack 147 can be made into a more formal pad by the application of padding adhesive along one end surface of the stack, for example either along the upper edge in FIG. 28 where the trimming is shown or along any one of the other edges. The formation of such pads is well known in this art, and if desired, a base sheet could be applied to the undersurface of the stack 147 prior to the application of the padding adhesive.

The individual pop-up elements 145 can then be peeled one by one from the stack 147 and can be used in substantially the same way as the pop-up elements 71, depicted in FIGS. 16–19. If, for example, the pop-up element 145 is inserted between panels or sections of the same page of a letter, generally along a crease line between panels 151*a* and 151*b*, When the letter is opened by the recipient, the pop-up element 145 will assume the three-dimensional configuration shown in FIG. 29, as a result of the joinder of the attachment subpanels 142 of the pop-up to opposite panels 151. More specifically, the central attachment subpanel 142*b* is attached to one panel 151*a* of the letter by the adhesive pattern 139, and the two flanking attachment subpanels 142*a* and 142*c* are attached by the adhesive patterns 137 to the adjacent panel 151*b* of the letter.

Depicted in FIGS. 30–34 is still another method for making pop-up elements that can be distributed as novelty items without attached basepieces. Shown is a continuous web 155 which is preferably printed in the form of a series of rectangular blanks 157 that will create structurally identical pop-up elements, each in the form of two hinged-together pop-up panels 159. A continuous adhesive pattern is applied along both lateral edges of the continuous web 155, with the pattern along the left hand edge carrying the reference numeral 161*a* and the pattern along the right hand edge carrying the reference numeral 161*b*. The adhesive is pressure-sensitive adhesive that will adhere strongly to the paperboard or other sheet material which constitutes the web 155 and that will only lightly adhere to itself. Such adhesives are readily available from adhesive formulators throughout the U.S. Following the application of the two pressure-sensitive patterns, the web 155 is folded in half along a centerline depicted, for reference purposes, by the dot-dash line 163 in FIG. 30. This line thereafter constitutes the foldline 163 between the separate panels 159.

The folded web is then die-cut to remove generally rectangular sections which are given the reference numeral 165 in FIG. 30 and which are located just laterally inward from the adhesive patterns 161 that were applied along the two edges of the continuous web. Each of the die-cut regions extends forward and rearward into adjacent blanks 157.

As depicted in FIG. 31, following the die-cutting operations, the once-folded web is then fan-folded so as to create stacks of individual pop-up elements 167, each having the appropriate number of individual units that it is desired to market as a composite stack or pad. For example, one way of accomplishing this end is to sever the continuous web transversely in sections of 25 units each, and fan-fold these 25-unit strips as shown in FIG. 31 to create a vertical stack 169. As depicted in FIG. 32, the completed stack 169 is then trimmed along both side edges by a suitable trimming knife means 171 to eliminate the interconnections along the trailing and leading edges of the adjacent blanks 159 and to thereby create a stack of 25 individual pop-up elements 167. Each of the elements remains detachably joined to the adjacent element through the face-to-face contact of the adhesive patterns 161*a* and 161*b*. If desired, a padding adhesive can be applied, preferably along the edge surface of the stack 169 where the adhesive patterns 161 are located, as explained hereinbefore with respect to the stack 147, depicted in FIG. 28.

When an individual pop-up element 167 is peeled from the stack 169, it constitutes a pair of hinged-together panels 159, each of which has a depending subpanel 172 carrying the pressure-sensitive adhesive pattern 161, which subpanel is connected thereto by a narrow neck 173 formed by the die-cutting operation that removed the rectangular sections 165. The pop-up element 167 is ready for insertion between the facing surfaces of two hinged-together pages 175*a* and 175*b* of a pamphlet or the like or between adjacent panels of a folded personal or business letter; attachment is made upon contact with the depending attachment panels via the pressure-sensitive adhesive patterns 161 which retain sufficient tack to strongly adhere to the usual paper materials. As depicted in FIG. 34, when the hinged-together panels 175*a* and 175*b* are spread apart, the pop-up element 167 assumes three-dimensional configuration with the panels 159 pivoting relative to each other along the hinge line 163.

Figure 35:
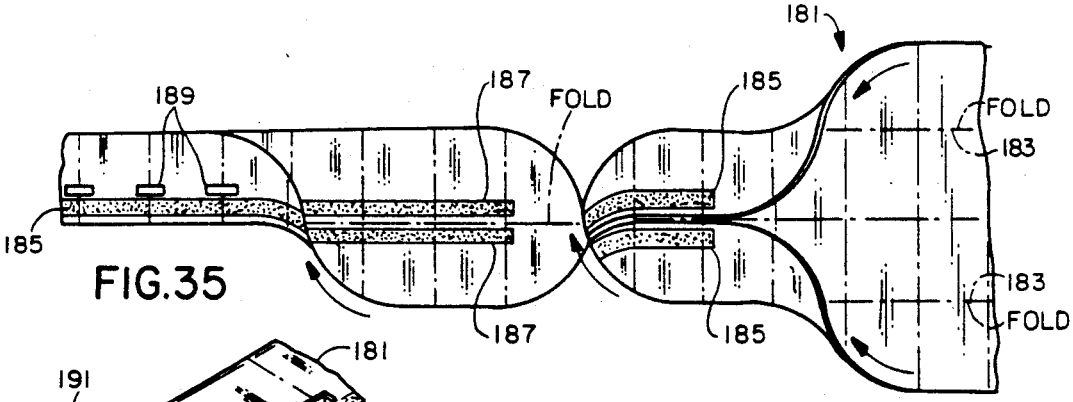
FIG. 35 is a plan view of a continuous web, shown somewhat schematically, which web has been printed so as to define a series of double blanks, each blank being designed to form a pop-up unit including a pair of panels similar to those units depicted in FIG. 33.

Shown in FIG. 35 is a continuous web 181 which is preferably printed in the form of a series of rectangular blanks that will each create two structurally identical pop-up elements each in the form of hinged-together pop-up panels. The web is folded along a pair of foldlines 183 so that each of the edge portions is folded over into superimposed relationship with the underlying adjacent central portion of the web. Upon completion of this first folding step, a pair of parallel lines 185 of pressure-sensitive adhesive are applied to the upper surface of the folded portions in flanking relationship to the centerline of the web.

Figure 36:
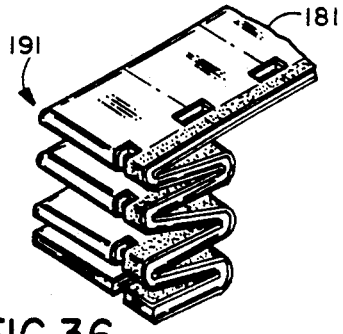
FIG. 36 is a perspective view, similar to FIG. 31, showing the continuous web of FIG. 35 being fan-folded.

Following the application of these two adhesive strips 185, the web is rotated 180, and an additional two parallel strips 187 of pressure-sensitive adhesive are applied to what was the original undersurface of the web, again flanking the centerline. A second folding operation is then effected so as to further fold web 181 along its centerline to create an assemblage that is four layers thick. The pressure-sensitive adhesive that is used is similar to that used in the method described with respect to FIGS. 30–34 which adheres strongly to the sheet material but only lightly to itself. The web is then die-cut to remove generally rectangular sections given the reference numeral 189 in FIG. 35. Thereafter, the web is then fan-folded as depicted in FIG. 36 to create a stack 191 of these individual pop-up elements 192, with each blank of the original continuous web providing two such elements.

Figure 37:
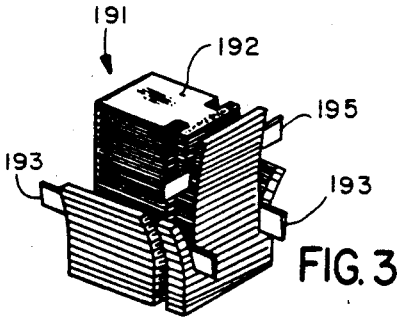
FIG. 37 is a perspective view, similar to FIG. 32, showing a stack (formed from a predetermined length of the web of FIG. 36) being severed to create a stack of individual pop-up units.

Once a stack 191 of the desired number of elements have been formed, the final cutting operation is effected, as depicted in FIG. 37, using suitable knives 193 and 195. Cutting along both side edges of the stack 191 by the knives 193 eliminates the interconnection of adjacent pop-up elements 192 along the foldlines that were created by the fan-folding operation, and the trimming along the bottom edge by the knife 195 eliminates the original foldline along the centerline of the web along which one panel of each of the two elements from each blank were originally joined. Once the trimming operation depicted in FIG. 37 is completed, the stack of pop-up elements is substantially indistinguishable from that produced in FIG. 32.

Figure 38:
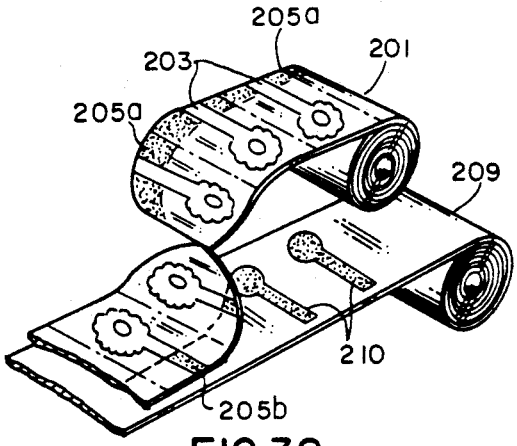
FIG. 38 is a perspective view of a continuous web which has been printed to define a series of blanks each containing a single pop-up unit generally similar to that shown in FIG. 27 being superimposed upon another continuous web.
Figure 39:
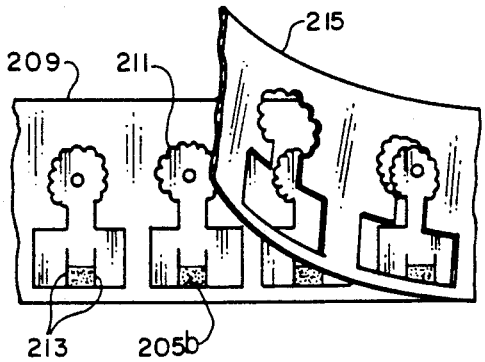
FIG. 39 is a view enlarged in size of a portion of the composite web produced by the method illustrated in FIG. 38 with the scrap portion being stripped therefrom.

Shown in FIG. 38 is an alternative method of making the pop-up elements of single sheet thickness of the type generally depicted in FIGS. 27–29. A generally similar continuous web 201 of sheet material, printed on both sides, is provided which is printed to constitute a series of individual blanks 203 that will form structurally identical pop-up elements. Pressure-sensitive adhesive patterns 205*a* are first applied on one surface of the web to the regions of the web which will constitute a pair of attachment subpanels. The web is then rotated 180°, and adhesive patterns 205*b* are applied to the opposite surface in the region of the single attachment subpanel. Instead of then die-cutting the web 201 as was done in the method depicted in FIG. 27, the web 201 is laid atop a continuous web 209 of carrier material to which patterns of pressure-sensitive adhesive 210 are strategically applied to coincide with the center of each blank. In some instances, depending upon the size of the pop-up element 211, the additional adhesive pattern 210 may be unnecessary, for it may be possible to rely upon the patterns 205*a* to secure the elements in place on the carrier web 209.

A kiss-cutting operation is then carried out similar to that depicted in FIG. 7. As a result of this kiss-cutting operation, the entire outline of the desired pop-up element 211 is effected by cutting through the single thickness of the printed web material 201 but not cutting into the liner material web 209. At the same time, parallel die-cuts 213 which extend upward from the base of the pop-up element 211 are simultaneously created. Thereafter, the scrap portion 215 of the continuous printed web is stripped therefrom, leaving a plurality of spaced-apart individual pop-up elements 211 attached by the pressure-sensitive adhesive patterns 210 and 205*a* to the underlying continuous web of liner material 209. The liner material 209 might then be severed to create strips of predetermined length each containing the desired number of pop-up elements 221 which are to be marketed as a unit; such strips can then be rolled so that the pressure-sensitive adhesive patterns 205*b* on the upper surface of the pop-up elements 211 are protected by the adjacent undersurface of the liner material strip. Thus, such rolled strips carrying the desired number of pop-up elements can be packaged and marketed in this fashion.

Figure 40:
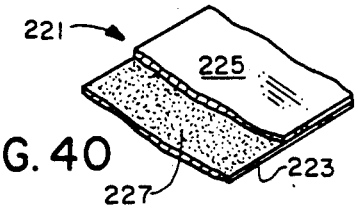
FIG. 40 is a fragmentary perspective view through a web of material that comprises a pair of separate sheets interconnected by a layer of pressure-sensitive adhesive material.

FIG. 40 illustrates composite web material 221 which is commercially available and which consists of two individual sheets 223, 225 with a relatively thick layer 227 of pressure-sensitive adhesive sandwiched therebetween. The adhesive 227 preferably adheres equally to both of the facing surfaces, and therefore, when a portion of either sheet is removed, a partial layer of pressure-sensitive adhesive will adhere to the surface of the removed portion as well as to the now-exposed surface of the underlying sheet. Alternatively, depending upon the construction of the pop-up elements, one of the sheets 223, 225 can be treated so the adhesive will preferentially adhere to the other sheet.

Figure 41:
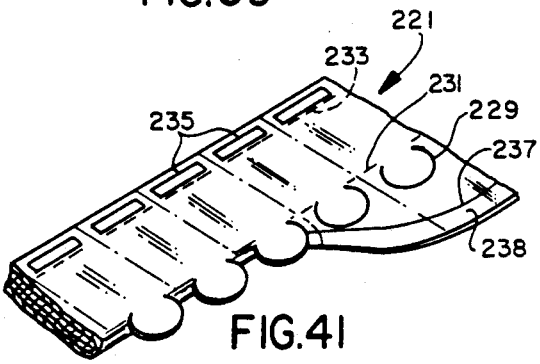
FIG. 41 is a perspective view, enlarged in size, of a continuous web of the material illustrated in FIG. 40 which has been printed so as to define a series of blanks each containing a pair of pop-up elements, which web is being kiss-cut, die-cut and manipulated so as to fabricate individual pop-up elements therefrom.

As depicted in FIG. 41, a continuous web of such material 221 is printed so as to provide a series of rectangular blanks, each of which constitutes a pop-up element in the form of a pair of panels which will ultimately remain hinged together along a line of weakness down the centerline of the web. A die-cutting operation is effected so as to die-cut the image of a circular head 229 completely through the entire composite web. At the same time, a line of weakness 231 is created in the region of the blank along the centerline of the web, which is interrupted by the neck of each die-cut head. Optionally, one or two parallel lines of weakness 233 can be created in the web near the lateral edges thereof to create distinct subpanels if desired. In addition, a kiss-cutting operation is carried out on the web so as to create a removable rectangular panel 235 in the upper sheet 225 in the region of one of the subpanels and to create a straight-line cut 237 through the upper sheet to define a second removable rectangular cover panel 238 adjacent the opposite edge of the moving web, which can be in addition to or in lieu of creating a line of weakness at the same location. Thereafter, the web is folded along the centerline so that the pop-up element panels are superimposed upon each other, and the folded web is then severed transversely to create individual pop-up units 239 (see FIG. 42).

Figure 42:
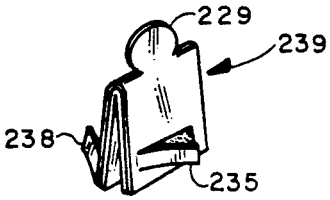
FIG. 42 is a perspective view of one such pop-up element as various subpanels are being peeled therefrom to expose the underlying pressure-sensitive adhesive which will then allow the pop-up element to be secured in place between a pair of hinged panels.

As depicted in FIG. 42, manual removal of the cover panel 235 created by the kiss-cutting exposes the pressure-sensitive adhesive region on the underlying surface of the interior sheet 223, and removal of the cover panel 238 likewise exposes the adhesive-covered subpanel of the sheet 223. These exposed adhesive regions allow the pop-up unit to be readily secured between the surfaces of a pair of facing panels of a letter or the pages of a book, as explained hereinbefore with respect to the pop-up unit 167 illustrated in FIG. 33.

Figure 43:
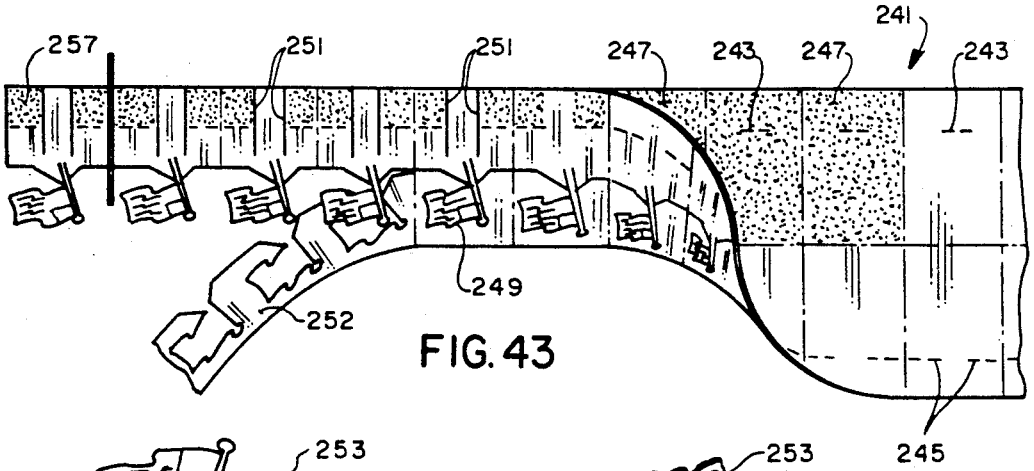
FIG. 43 is a schematic view of still another continuous web which has been printed to define a series of blanks each containing a pair of pop-up elements which is being subjected to several die-cutting operations and an adhesive application step as a part of its fabrication into pop-up elements.

Disclosed in FIG. 43 is a continuous web 241 of sheet material that has been printed so as to constitute a series of blanks each in the form of a pair of pop-up panels located on opposite sides of the centerline of the web. A die-cutting operation is first performed so as to create perforations 243, 245 in regions to eventually define subpanels, which perforations extend along lines parallel to the direction of travel of the web. The upper surface of each pop-up element panel along the upper half of the web (FIG. 43) is then coated overall with a layer of pressure-sensitive adhesive 247; alternatively a smaller pattern of adhesive could be applied to cover key regions. The web is then folded to superimpose the panels upon each other and sandwich the layer of pressure-sensitive adhesive between the folded web. The pressure-sensitive adhesive is such that some of the adhesive will adhere to both facing surfaces of the folded web so that, as in the material depicted in FIG. 40, when a portion of one sheet is removed, there will be pressure-sensitive adhesive remaining, now exposed, on the surface of the underlying portion of the pop-up element.

Figure 44:
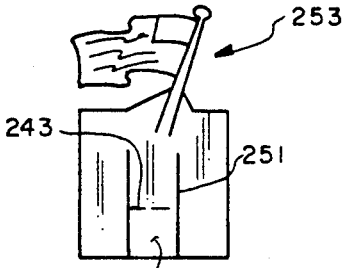
FIG. 44 is a rear view of one of the pop-up elements fabricated by severing from the web illustrated in FIG. 43.
Figure 45:
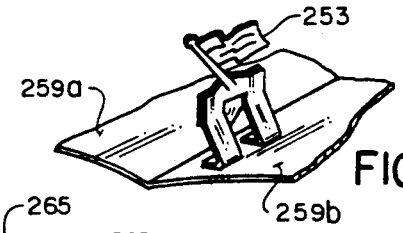
FIG. 45 is a perspective view showing the pop-up element of FIG. 44 in display position between a pair of hinged panels.

Following the folding operation, a die-cutting operation is carried out so as to die-cut the FIG. 249 of a flag and flagpole along one edge of the folded web creating a strip of waste 252 and to die-cut a pair of parallel lines 251 transverse to the direction of travel of the web extending inward from the opposite edge of the web 241. Waste 252 from the die-cutting of the flag figures is stripped away using any suitable state-of-the-art method of waste removal, and the web is then severed to create individual pop-up elements 253, as depicted in FIG. 44. If it should be desired to balance waste removal for manufacturing efficiency, a waste strip could also be used along the opposite lateral edge of the folded web. The pair of die-cut lines 251 and the perforations 243 create a single removable panel 255 on the rear surface of the unit, and the die-cut lines and the perforations 245 create two removable panels 257 on the front surface of each element, as seen in FIG. 43. Removal of these three panels exposes the pressure-sensitive adhesive and readies the pop-up element 253 for insertion between facing surfaces of a pair of hinged panels, for example, the folded portions 259*a,b* of a business letter or the like. When the letter is opened, as depicted in FIG. 45, the pop-up element 253 automatically assumes its three-dimensional display orientation.

Figure 46:
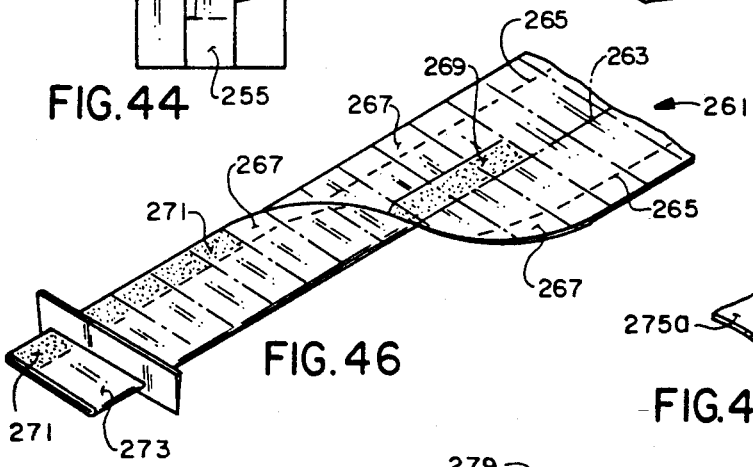
FIG. 46 is a perspective view of yet another continuous web which has been printed to define a series of blanks each containing a pair of panels which are subjected to a series of steps to apply adhesive and create lines of weakness before being severed into individual pop-up elements.

Illustrated in FIG. 46 is a continuous web 261 of sheet material that has been printed so as to constitute a series of rectangular blanks, each in the form of a pair of pop-up panels located on opposite sides of the centerline 263 of the web, which blanks are designed to form single pop-up elements of structurally identical construction which could however be printed with different designs if desired. Preferably, a pair of lines of weakness 265 are impressed in the continuous web, spaced inward from its lateral edges, to create subpanels 267. At about the same time, a strip of permanent adhesive 269 is laid down adjacent the centerline, which adhesive is designed to cause permanent adherence between the facing portions of the two hinged panels. The web is then folded along the centerline 263 to bring the pop-up panels into superimposed position, creating this permanent adhesive bond.

Following the folding step, strips of pressure-sensitive adhesive 271 are applied to the outer surfaces of both subpanels 267. The application can be made simultaneously upon the upper and lower surfaces of the continuously moving web. Alternatively, the adhesive strip 271 can be applied to the upper surface of the web, and the web then rotated 180 before a similar adhesive strip is applied to the upper surface of the other subpanels 267. As a further alternative, a pressure-sensitive adhesive strip could be applied initially along both edges of the continuous web 261, and the web could then be rotated 180 prior to the application of the permanent adhesive strip 269.

Following the application of the pressure-sensitive adhesive strips 271, the web can be severed into individual units 273 which are then applied to a carrier web or accumulated in a stack or handled in any other way as described hereinbefore; alternatively, the web can be cut into multiple unit lengths that are fan-folded. The pressure-sensitive adhesive should be such that it will adhere strongly to the web material but will only adhere lightly to itself if it is intended that the pop-up elements 273 are to be distributed in a stack. When one of the elements is removed from such a stack and placed between facing panels 275*a*, 275*b* of a business letter or the like, the pressure-sensitive adhesive 271 attaches the pop-up element subpanels 267, respectively, to one of the facing panels of the letter, and when the letter is opened, as shown in FIG. 47, the pop-up element 273 automatically assumes its three-dimensional display orientation.

Figure 47:
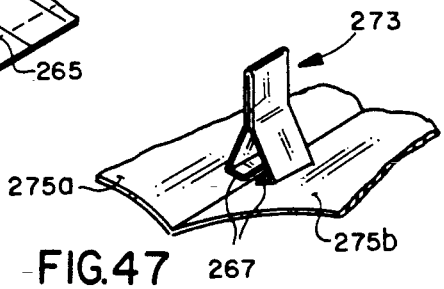
FIG. 47 is a perspective view showing the pop-up element of FIG. 46 in display position between a pair of hinged panels.
Figure 48:
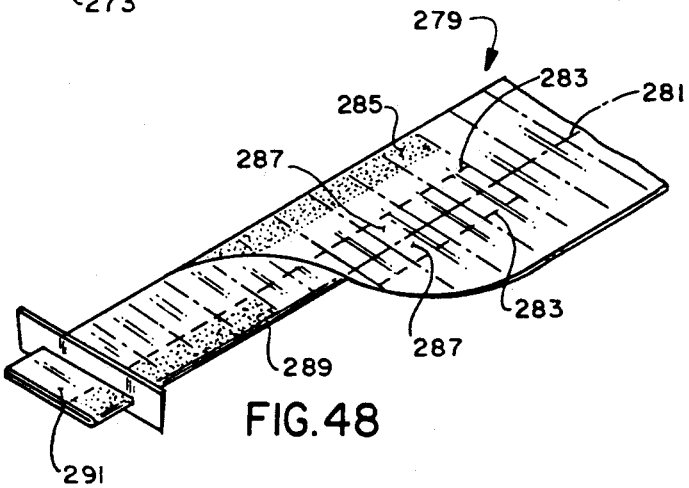
FIGS. 48 and 49 are similar to FIGS. 46 and 47, respectively, showing the fabrication of an alternative embodiment of the pop-up element to that illustrated in FIG. 47.

Illustrated in FIG. 48 is a continuous web 279 of sheet material that has been printed to constitute a series of rectangular blanks, each in the form of a pair of pop-up panels located on opposite sides of the centerline 281, which panels are designed to form pop-up elements generally similar to that depicted in FIG. 47 but of a slightly different construction. A pair of lines of weakness 283 are preferably impressed in the web 279 in flanking relationship to the centerline 281, and a strip of permanent adhesive 285 is preferably applied along one edge of the web. The lines of weakness create subpanels 287 lying on opposite sides of the centerline 281. The web is then folded in half along the centerline 281 so as to superimpose one panel of each blank atop the other. As a result of the folding, the lateral edges of the web become adhered to each other via the permanent adhesive strip 285. Thereafter, strips of pressure-sensitive adhesive 289 are applied to the upper and lower surfaces of the web in the regions of the subpanels 287. As explained with respect to FIG. 46, the strips 287 can be applied simultaneously to the upper and lower surfaces of the moving web, or one can be applied first before the other, with a 180 rotation of the web taking place in between. The folded and glued web can then be cut into individual units 291 or can be cut into multiple units, as explained hereinbefore, which units may be distributed as a stack or in some other suitable arrangement.

Figure 49:
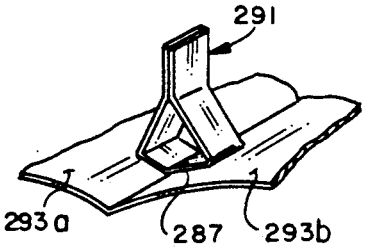

When one of the pop-up elements 291 is peeled from such a stack and placed between the panels 293*a*, 293*b* of a letter, or between the pages of a pamphlet, a book or the like, the subpanels 287, which remain hinged together along a foldline that was originally the centerline 281 of the web, become adhered to the facing panels 293*a*, 293*b* via the pressure-sensitive adhesive patterns 289. When the letter is opened, as depicted in FIG. 49, the pop-up element 291 automatically assumes its three-dimensional display orientation.

Figure 50:
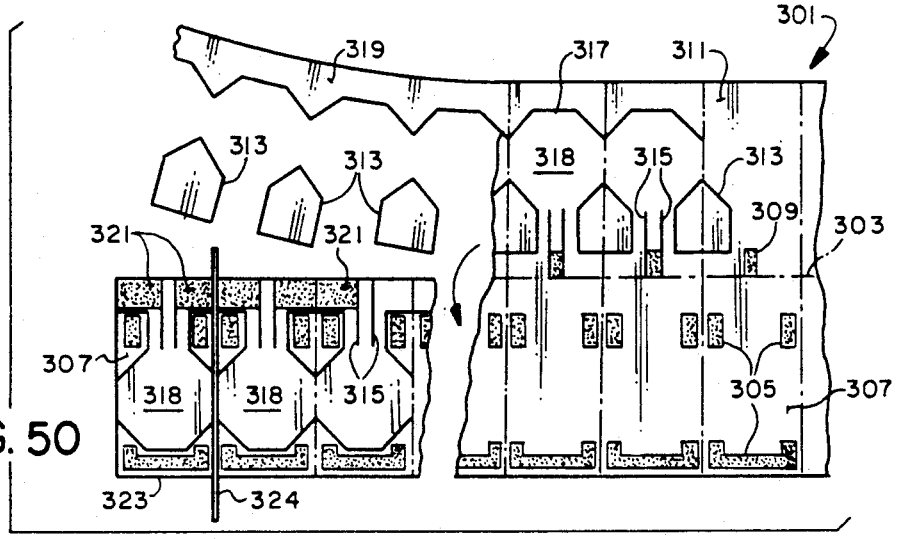
FIG. 50 is a plan view of a continuous web which has been printed to define a series of structurally identical blanks each containing one basepiece and one pop-up element which is shown being subjected to a series of steps of die-cutting, adhesive application, scrap removal, folding and severing as a part of its fabrication into pop-up units.

Illustrated in FIG. 50 is a continuous web 301 of sheet material that has been printed so as to constitute a series of rectangular blanks, each of which blanks includes one pop-up element and one basepiece, on opposite sides of the centerline 303 of the web. A peripheral pressure-sensitive adhesive pattern 305 is applied in the form of three separate spaced locations located generally along the periphery of the basepiece panel 307 of each blank. A single adhesive pattern 309 is applied to the pop-up element panel 311 of the web at a location generally adjacent the centerline 303 which is preferably of permanent adhesive but could be of pressure sensitive adhesive that would create a strong bond. Die-cutting is carried out so as to die-cut a series of spaced pentagons 313 along the centerline of the web, to create a pair of parallel lines 315 between these pentagons, and to create a contoured edge 317 inward of the upper edge of the web, as depicted in FIG. 50, defining a series of pop-up elements 318 therein. Following the die-cutting operation, the die-cut pentagons 313 and the upper edge portion 319 of the web may be removed as scrap before the die-cut upper half of the web is folded along the centerline 303 so as to lie upon the lower half of web which carries the peripheral pressure-sensitive adhesive pattern 305. Alternatively, the folding step may be carried out before the removal of the die-cut pentagons to facilitate folding; however, so long as the pentagon die-cuts are spaced about an inch or more from the centerline 303, it should be possible to fold without difficulty using state-of-the-art methods. Once the folding operation is completed, the permanent adhesive pattern 309 aids in retaining the folded web in this condition.

Following folding, pressure-sensitive adhesive patterns 321 are applied to what is now the upper surface of the folded pop-up element 318 in the regions just flanking the die-cut lines 315 and generally adjacent the centerline 303. The adhesive 321 preferably is such as to create a stronger bond than the peripheral adhesive pattern of the pressure-sensitive adhesive 305 which lies outward of the boundary of the die-cut pop-up element 318. The folded web can be then severed by a knife blade 324 into individual units 323 each including one basepiece 307 and a superimposed pop-up element 318. The units 323 can be distributed attached to a carrier web similar to the arrangement shown in FIG. 15, or a web of release-coated material could be superimposed onto the individual units as they are severed using the pressure-sensitive adhesive patterns to effect joinder. They may also be distributed arranged in a stack or in any other suitable manner as hereinbefore described.

Alternatively, it might be most efficient to apply the folded web to a carrier web and then carry out the severing into individual units by kiss-cutting as shown in FIG. 7.

Figure 51:
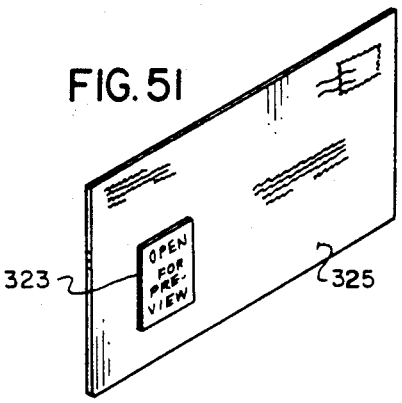
FIG. 51 is a perspective view, reduced in size, showing one of the pop-up units from FIG. 50 having been applied to the front face of a mailing envelope.
Figure 52:
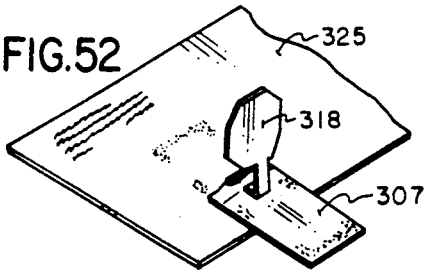
FIG. 52 is a fragmentary perspective view of the envelope depicted in FIG. 51 with the pop-up unit fully opened in its display position.

The pop-up unit 323 can be applied to any suitable supporting surface, for example to the front panel of an envelope 325, as depicted in FIG. 51. When the recipient opens the unit by grasping the upper edge and pulling it downward, the weaker pressure-sensitive adhesive pattern 305 is broken, allowing the basepiece 307 to be folded downward, pivoting along the hinge line that was originally the centerline 303 of the web. The pressure-sensitive adhesive patterns 321, which most preferably have a semi-permanent bond which is stronger than the adhesive 305, remain attached to the front surface of the envelope 325, as depicted in FIG. 52. Thus, the patterns 321 and the permanent adhesive bond 309 between the central portion of the pop-up element and the basepiece 307 causes the pop-up element 318 to assume an upstanding three-dimensional configuration.

Figure 53:
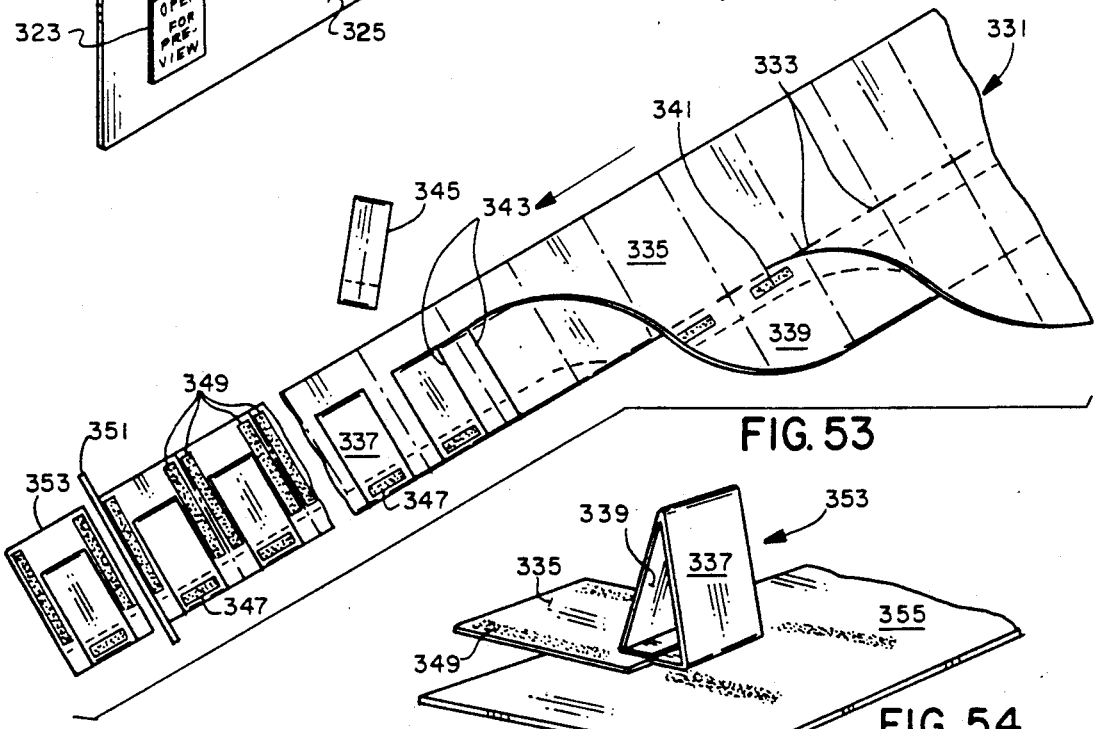
FIG. 53 is a view similar to FIG. 50 of a continuous web which has been printed to define a series of structurally identical blanks for forming an alternative embodiment of units of the type shown in FIG. 52.
Figure 54:
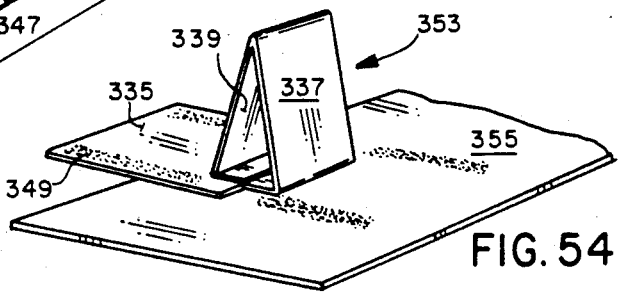
FIG. 54 is a view similar to FIG. 52 of a pop-up unit made from the web shown in FIG. 53.

Illustrated in FIG. 53 is a continuous web 331 of sheet material that has been printed so as to constitute a series of side-by-side rectangular blanks, each of which includes a single basepiece and a pair of panels that will constitute a pop-up element. The continuous web, which is moving in the direction of the arrow, is first die-cut to produce a series of spaced-apart die-cuts 333 which are located in the blank at the junction between the basepiece panel 335 and the remainder of the blank which constitutes the pop-up element. The lower or left hand portion of the web, as viewed in FIG. 53, is then folded along the centerline of the pop-up element portion of the blank to create pop-up panels 337 and 339 of substantially equal dimension which are superimposed one atop the other. An adhesive pattern 341 of permanent-type adhesive is then applied to the pop-up panel 339 generally along its free edge.

The web 331 is then folded again along a longitudinal line defined by the series of die-cuts 333 to superimpose the pop-up element portion atop the basepiece portion of the web. The twice-folded web is then kiss-cut so as to cut through only the two thicknesses of the pop-up element portion thereof along parallel lines 343 that are spaced apart a distance equal to the length of the die-cuts 333 and aligned therewith. The generally rectangular, folded, scrap portions 345 created by the kiss-cutting are suitably removed using state of the art methods. A pressure-sensitive adhesive pattern 347 of relatively strong bond strength is then applied to the upper surface of the pop-up portion of the web, and an adhesive pattern 349 of pressure-sensitive adhesive having a weaker bond strength is applied to the portions of the basepiece which become exposed by the removal of the rectangular kiss-cut sections. Finally, the web is cut along parallel lines between the individual blanks using a suitable knife blade 351 or its equivalent to create individual pop-up units 353. Alternatively, these individual pop-up units 353 which are created from the continuous web 331 can be severed from one another, handled and distributed in any of the ways described above with respect to the pop-up units illustrated in FIGS. 50–52.

The individual pop-up units 353 may be designed to be applied to the front of an envelope 355 or the like with the hinge line at the top and with the free edge of the basepiece 335 at the bottom. When the free edge of the basepiece is lifted, the weaker bonds of the pressure-sensitive adhesive patterns 349 part, releasing the basepiece 335 from direct contact with the outer surface of the envelope 355. The bond strength of the stronger pressure-sensitive adhesive pattern 347 secures the pop-up panel 337 to the face of the envelope along its upper edge, causing the basepiece 335 to pivot along the fold line created between the spaced-apart die-cuts 333. The permanent adhesive bond created by the adhesive pattern 341 between the facing surface of the basepiece and the pop-up panel 339 pulls one-half of the folded pop-up element toward it, causing the pop-up element to assume a three-dimensional configuration. If desired, lines of weakness can be impressed or otherwise added to the continuous web at an appropriate time, for example at about the time of the die-cutting step, in locations adjacent the edges of the adhesive patterns 341 and 347 so as to create more distinct subpanels and provide a sharper, overall appearance.

Although the invention has been described with regard to certain preferred embodiments, it should be understood that various changes and modifications as would be obvious to one having the ordinary skill in this art may be made without departing from the scope of the invention which is set forth in the claims appended hereto. For example, the pop-up elements can be made in various forms from a single sheet that is die-cut to form a plurality of subpanels, and instead of being formed with three subpanels, only two subpanels may be used, one having adhesive on one surface and the other having adhesive on the opposite surface. In addition, a single sheet can be folded upon itself to create an interconnected subpanel along the base of a pop-up element which carries adhesive on the exterior surface while a die-cut subpanel portion of the pop-up element carries adhesive on the opposite surface. Instead of folding the web 155 along the centerline 163 as depicted in FIG. 30, a line of weakness could be impressed at this location and the pop-up element 167 could be distributed flat, relying on the pressure-sensitive adhesive patterns 161 to interconnect adjacent units in the stack.

Although fabrication from a continuous roll is preferred, cut sheets containing multiple rectangular blanks might be used in some cases. Instead of die-cutting one blank at a time, two or more blanks might be die-cut as a group, which would allow for the creation of different shapes; in such a case the pop-up elements which result might have a different appearance but would be structurally identical in that the foldlines or the like which are created in the manipulating steps would be in precisely the same locations. In any of these constructions, instead of employing the pressure sensitive adhesive patterns to attach the pop-up elements to a carrier web or the like, one might protect the adhesive pattern by covering it with a release liner and then use separate pressure sensitive adhesive patterns, that leave no residue upon detachment, to position the pop-up elements for distribution. Moreover, although the preferred adhesive pattern applications are depicted, it should be understood that application of the adhesive pattern to the corresponding surface portion of the web where there will be surface-to-surface contact following folding or other manipulation may be carried out. Furthermore, the adhesive patterns can be applied in any suitable manner; for example, instead of applying liquid adhesive in FIGS. 27 or 00, strips of double-faced adhesive material, similar to carpet-laying tape, might be used.

Although the term "pop-up" element is used throughout to refer to the illustrated sheet material structures, it is intended to broadly encompass any flat sheet material structures that are easily displayable in three-dimensional form as a result of pressure-sensitive adhesive carried thereupon.

Particular features of the invention are emphasized in the claims that follow.

What is claimed is:

1. A mass production method for making pop-up items, which method comprises providing a first continuous web of sheet material printed to provide a series of individual blanks for fabrication into structurally identical pop-up items, applying a first pattern of pressure-sensitive adhesive to the upper surface of said first continuous web of sheet material at a series of longitudinally spaced-apart discrete regions, manipulating said first continuous web of sheet material so that the undersurface thereof becomes the upper surface thereof, applying a second pattern of pressure-sensitive adhesive to the upper surface of said manipulated first web of sheet material in a series of longitudinally spaced discrete regions of said web different than said regions to which said first pattern of pressure-sensitive adhesive was applied.

disposing said first sheet material web atop a second continuous web of carrier material so that said two webs become joined together by pressure-sensitive adhesive carried on at least one of said webs, kiss-cutting said first web to create the outline of each of a series of structurally identical pop-up elements from said first web without cutting into said second web, while simultaneously cutting into the outline of each of said pop-up elements to create a plurality of subpanels in each said pop-up element, and stripping a continuous scrap portion of said first web from its location atop said second carrier web so as to leave a plurality of structurally identical, longitudinally spaced-apart pop-up elements located along said second web and secured thereto by said pressure-sensitive adhesive, said pop-up elements each having subpanels carrying pressure-sensitive adhesive regions which respectively are located on opposite surfaces thereof, whereby said individual pop-up elements can be readily adhered between a pair of facing panels of sheet material.

2. A method in accordance with claim 1 wherein a third pattern of pressure-sensitive adhesive is applied to the upper surface of said second carrier web in regions wherein it will align with said series of pop-up elements following said joinder of said two webs.

3. A method in accordance with claim 2 wherein said second carrier web is made of liner material which includes a release coating upon both surfaces thereof and wherein said continuous second web carrying said longitudinally spaced-apart pop-up elements is cut into segments of finite length carrying predetermined numbers of said pop-up elements and then said segments are rollded so that said discrete regions of said second pressure-sensitive adhesive patterns which appear upon the upwardly facing surfaces of said pop-up elements are in contact with the release-coated undersurfaces of said second carrier web.

4. A method in accordance with claim 3 wherein a pair of parallel cuts are kiss-cut into each pop-up element so as to create three separate subpanels each of which subpanels carries said pressure-sensitive adhesive on only one surface thereof.

5. A mass production method for making pop-up items, which method comprises providing a first continuous web of sheet material printed on both its upper and lower surfaces to provide a series of individual blanks for fabrication into structurally identical pop-up items, applying a first pattern of pressure-sensitive adhesive to the upper surface of said first continuous web of sheet material at a series of longitudinally spaced-apart discrete regions along said web, turning said first continuous web of sheet material 180° so that the undersurface thereof becomes the upper surface thereof, applying a second pattern of pressure-sensitive adhesive to the upper surface of said first web of sheet material after said turning in a series of discrete regions along said web different than said regions to which said first pattern of pressure-sensitive adhesive was applied, disposing said first sheet material web atop a second continuous carrier web of liner material having a release coating on its surfaces, after first applying a third pattern of pressure-sensitive adhesive to the upper surface of said liner material web in spaced regions which align to the center of each blank on said first web, so that said two webs become joined together by said pressure-sensitive adhesive patterns on both of said webs, kiss-cutting said first web to create the entire outline of each of a series of longitudinally spaced-apart structurally identical pop-up elements from said first web without cutting into said second web, while simultaneously cutting into each of said pop-up elements to create a plurality of subpanels in each said pop-up element, stripping a continuous scrap portion of said first web from its location atop said second web so as to leave a plurality of structurally identical, longitudinally spaced-apart pop-up elements located along said second web and secured thereto by said pressure-sensitive adhesive, each of said pop-up elements having subpanels carrying pressure-sensitive adhesive in regions which are respectively located on opposite surfaces thereof, whereby said individual pop-up elements can be readily adhered between a pair of facing panels of sheet material, cutting said continuous second web of spaced-apart pop-up elements into segments of finite length, and rolling said cut segments so that said discrete regions of said pressure-sensitive adhesive of said second pattern which appear upon the upwardly facing surfaces of said pop-up elements are in contact with the release-coated undersurface of said second carrier web.

* * * * *